US005749571A

United States Patent [19]

Heiler

[11] Patent Number: 5,749,571

[45] Date of Patent: May 12, 1998

[54] DEVICE FOR FORMING A SHEET PILE

[75] Inventor: Peter Heiler, Forst, Germany

[73] Assignee: Heidelberger Druckmaschinen AG, Heidelberg, Germany

[21] Appl. No.: 564,418

[22] Filed: Nov. 29, 1995

[30] Foreign Application Priority Data

Nov. 29, 1994 [DE] Germany ..... 44 42 385.3

[51] Int. Cl.[6] ..... B65H 31/04

[52] U.S. Cl. ..... 271/213; 271/218; 271/221; 414/790.8

[58] Field of Search ..... 414/790.8; 271/213, 271/218, 221; 101/222, 240, 241, 242, 238, 239

[56] References Cited

U.S. PATENT DOCUMENTS

| | | | |
|---|---|---|---|
| 3,966,196 | 6/1976 | Simeth | 271/218 |
| 5,005,822 | 4/1991 | Max et al. . | |
| 5,377,588 | 1/1995 | Fricke | 271/218 |

FOREIGN PATENT DOCUMENTS

| | | | |
|---|---|---|---|
| 3836571 | 1/1991 | Germany . | |
| 003937944 C | 4/1991 | Germany | 271/218 |

*Primary Examiner*—H. Grant Skaggs
*Attorney, Agent, or Firm*—Herbert L. Lerner; Laurence A. Greenberg

[57] ABSTRACT

Device suitable for removing test sheets from sheet-fed printing presses includes leading-edge stops for a downwardly directed sheet stream, the stops being pivotable by a stop lever, and catch arms articulatedly connected to catch levers, the catch arms being adjustable by a tilt lever from outside the sheet stream into a catch position therewithin, as well as a spring engaging with the stop lever, the leading-edge stops being pivotable against the action of the spring out of a stop position and into a release position after the catch arms have reached the catch position thereof. This follow-up control is realized by a linearly adjustable adjusting member with a cam and a sliding block which is maintained in continuous engagement in a slot or coulisse formed in the tilt lever, while the cam is maintained in alternating operating connection with the stop lever and a spring leg of the spring which is formed as a leg spring.

4 Claims, 2 Drawing Sheets

DEVICE FOR FORMING A SHEET PILE

BACKGROUND OF THE INVENTION

1. Field of the Invention

The invention relates to a device for forming a sheet pile from a sheet stream made up of substantially horizontally oriented descending sheets of paper, having leading-edge stops for the sheets, the stops being disposed on a front side of the pile; a stop shaft carrying the leading-edge stops; a stop lever which is secured to the stop shaft, and is pivotable between a first and a second stop lever position in the course of a change between a first and a second mode of operation of the device, respectively, the stop lever, in the first stop lever position, keeping the leading-edge stops in engagement with the pile and, in the second stop lever position, keeping the leading-edge stops in a release position pivoted away from the pile; a spring engaging with the stop lever and, in a state of tension, having a tendency to keep the stop lever in the first stop lever position; a catch device with catch arms which, in the first operating mode of the device, are located in a basic position outside the sheet stream and, in the second operating mode, are in a catch position wherein they enter into or engage in the sheet stream; catch levers to which the catch arms are articulatedly connected; a catch lever shaft parallel to the stop shaft and carrying the stop lever; and having a tilt lever secured to the catch lever shaft and being pivotable between a first and a second tilt lever position upon a change between the first operating mode and the second operating mode, respectively, the tilt lever, in the first tilt lever position, maintaining the catch arms in the basic position thereof and, in the second tilt lever position, maintaining the catch arms in the catch position thereof. Such a device has become known heretofore from the published German Patent Document DE 38 36 571 C2. This heretofore known device has indeed proven to be advantageous in that a lever mechanism provided therein for adjusting the stop lever and the tilt lever automatically maintains respective end positions of these levers under the influence of a dead center spring. To gain this advantage, however, with every change in the operating mode, a relatively great force must be brought to bear to actuate the lever mechanism, because the action of the dead center spring must be overcome for every actuation of the lever mechanism. Moreover, a first and a second lost motion is realized by means of slots formed in corresponding levers of the lever mechanism for implementing the flapping of the leading-edge stops from the stop position thereof to the relief position thereof following the adjustment of the catch arms from the basic position thereof to the catch position thereof. No manufacturing problems have been encountered with respect to the formation of the slots in the respective levers.

2. Summary of the Invention

It is accordingly an object of the invention to provide a device for forming a sheet pile which requires the simplest possible construction parts, and which affords a change in operating mode with the least possible expenditure of force.

With the foregoing and other objects in view, there is provided, in accordance with the invention, a device for forming a sheet pile from a sheet stream made up of substantially horizontally oriented descending sheets of paper, having leading-edge stops for the sheets, the stops being disposed on a front side of the pile; a stop shaft carrying the leading-edge stops; a stop lever which is secured to the stop shaft and is pivotable between a first and a second stop lever position in the course of a change between a first and a second mode of operation of the device, respectively, the stop lever, in the first stop lever position, keeping the leading-edge stops in engagement with the pile and, in the second stop lever position, keeping the leading-edge stops in a release position pivoted away from the pile; a spring engaging with the stop lever and, in a state of tension, having a tendency to keep the stop lever in the first stop lever position; a catch device with catch arms which, in the first operating mode of the device, are located in a basic position outside the sheet stream and, in the second operating mode, are in a catch position wherein they enter into the sheet stream; catch levers to which the catch arms are articulatedly connected; a catch lever shaft parallel to the stop shaft and carrying the catch levers; and a tilt lever secured to the catch lever shaft and being pivotable between a first and a second tilt lever position upon a change between the first operating mode and the second operating mode, respectively, the tilt lever, in the first tilt lever position, maintaining the catch arms in the basic position thereof and, in the second tilt lever position, maintaining the catch arms in the catch position thereof, comprising a cam adjustable along an adjusting path between a first and a second cam position; the cam maintaining the spring in a state of tension in the first cam position and along a segment of the adjusting path originating at the first cam position, and maintaining the stop lever in the second stop lever position in the second cam position; the tilt lever being formed with a slot or coulisse; a sliding block adjustable jointly with the cam being engageable in the slot formed in the tilt lever; the sliding block maintaining the tilt lever in the first and second tilt lever position, respectively, when the cam assumes the first and second cam position thereof, respectively.

In accordance with another feature of the invention, the spring is constructed as a leg spring. In accordance with a further feature of the invention, an adjusting member carrying the cam and the sliding block is provided.

In accordance with a concomitant feature of the invention, the adjusting path is aligned horizontally and perpendicularly to the stop shaft.

According to the invention, a first lost motion for realizing the aforementioned sequence in the change of position of the stop lever, on the one hand, and the tilt lever, on the other hand, is produced by a cam which, in a first cam position and in a segment of an adjusting path of the cam, which originates at the cam, maintains a spring in a state of tension and, by means of the force of the spring, the front or leading-edger stops are maintained in the stop position. In connection with the construction of the aforementioned spring as a leg spring in accordance with the invention, a relatively simple design option, from a production standpoint, results with regard to the construction parts which are responsible for the aforementioned first lost motion.

A second lost motion for realizing the aforementioned sequence in the change of position of the stop lever, on the one hand, and the tilt lever, on the other hand, is accomplished according to the invention with a sliding block which is adjustable conjointly with the aforementioned cam and engages in a slot or coulisse formed in the tilt lever. Once again, the result, compared with the means employed in the aforementioned heretofore known device for realizing a lost motion is a more favorable construction in production terms for the responsible for the aforementioned second lost motion. The aforementioned feature of the invention wherein the contact between the leg spring and the cam which causes the state of tension in the leg spring is restricted to merely one segment of the aforementioned adjusting path facilitates the actuation of the device according to the invention with respect to the expenditure of force required for that purpose. Moreover, this expenditure of force can be further reduced to a relatively low level by means of a favorable lever ratio of the legs of the leg spring. A further reduction in the required expenditure of force can optionally be attained by a rolling contact of the cam with the leg spring.

In a preferred embodiment of the device according to the invention, an adjusting member which carries the cam and the sliding block is provided. Thus the joint adjustability of the cam and the sliding block, in accordance with the invention, is accomplished in the simplest possible way. A horizontal orientation of the adjusting path, at right angles to the stop shaft, is also preferably provided. The overall result is that, in a relatively simple manner, it becomes possible to equip the device of the invention with an ergonomically, advantageously placed actuating member.

A preferred application of the device according to the invention, particularly, is in a delivery of a sheet-fed printing press, specifically for the case wherein a sample sheet is manually removed while the sheet-fed printing press is in the production printing mode, in the course of which a sheet stream of substantially horizontally oriented dropping, i.e., descending, sheets is in the delivery. Other features which are considered as characteristic for the invention are set forth in the appended claims.

Although the invention is illustrated and described herein as embodied in a device for forming a sheet pile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENT

Figure 1B:
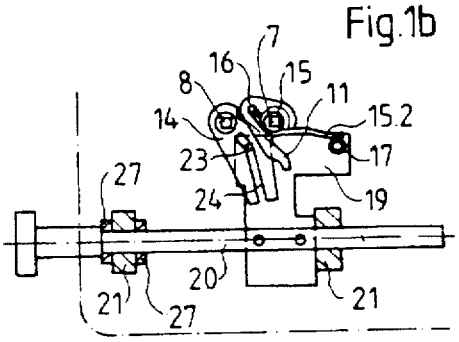
FIG. 1*b* is a fragmentary side elevational view, in a different plane, of the delivery of FIG. 1 showing the catch device without the leading-edge stops secured to the stop shaft, without the catch levers secured to the catch lever shaft, and without the catch arms pivotally connected to the catch levers.
Figure 1A:
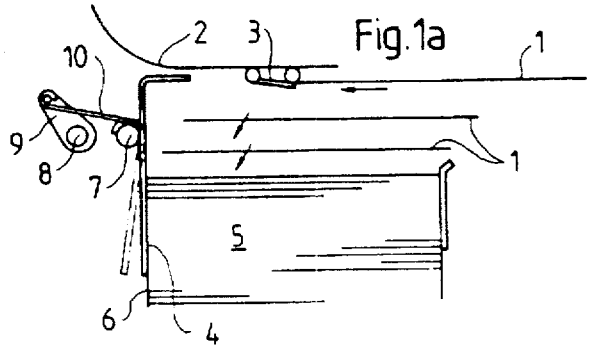
FIG. 1*a* is a diagrammatic side elevational view of a delivery of a sheet-fed printing press in a first operating mode of the device according to the invention, wherein sheets of a sheet stream are deposited continuously upon a sheet pile, only a stop shaft with leading-edge stops secured thereto, a catch lever shaft with catch levers secured thereto, and catch arms pivotally connected to the catch levers being all that is shown of a catch device forming part of the pile-forming device according to the invention.
Figure 3B:
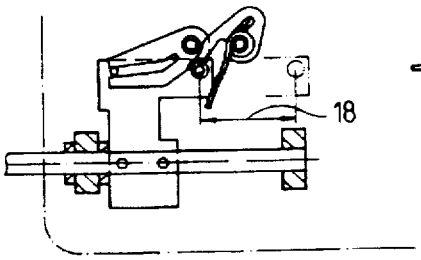
Figure 3A:
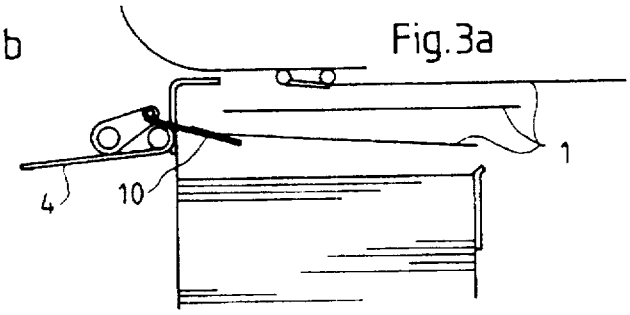
Figure 5:
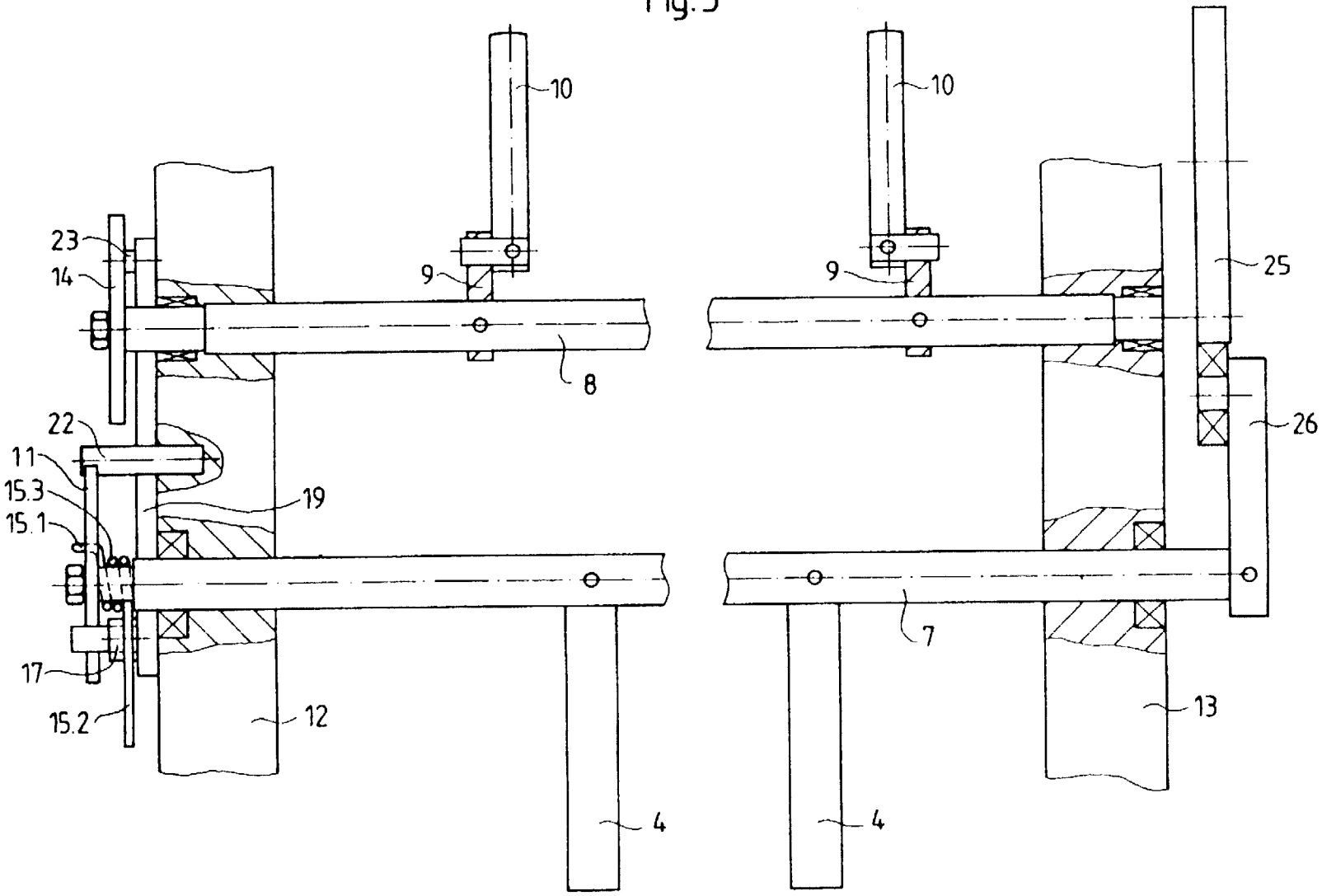
FIG. 5 is an enlarged, developed end view, partly in section and partly broken away, of FIGS. 1*a* and 1*b*.

Referring now to the drawings and, first, particularly to FIG. 1*a*, there is shown therein, represented by directional arrows, a substantially horizontally oriented sheet stream formed of descending or dropping sheets 1. This sheet stream is supplied by successive sheets of paper 1, which are initially guided by means of grippers 3 carried by chains 2 along a path determined by the chains 2, and are then released from the grippers 3 at a suitable distance from leading-edge or front stops 4 located in a stop position as shown in FIG. 1*a*, and are deposited upon one another, forming a pile or stack 5 oriented with the front stops 4, a front side 6 of the sheet pile 5 being thus formed facing towards the front or leading-edge stops 4. The front stops 4 are secured to a horizontal stop shaft 7 which is parallel to the front side 6 of the sheet pile 5. Catch levers 9, to which catch arms 10 are pivotally connected, are fastened to a catch lever shaft 8 extending parallel to the stop shaft 7. The catch arms 10 are in a basic position outside the sheet stream, in a first operating mode of the device shown in FIG. 1*a*, and described in further detail hereinafter. In the aforementioned basic position, it is apparent that the successive sheets 1 drop without any hindrance. A second operating mode of the device is illustrated in FIGS. 3*a* and 3*b*. In this regard, the catch arms 10 extend into the sheet stream and thus form a gap in the sheet stream in a region beginning at the front side 6 of the sheet pile 5, which permits access to at least an uppermost sheet 1 deposited on the pile 5, after which the front or leading-edge stops 4, due to a suitable actuation of the stop shaft 7, are located in release position in which they are pivoted away from the pile 5. The aforementioned suitable actuation of the stop shaft 7 is effected by means of a stop lever 11 which is secured thereto and which, in the course of a change between the first operating mode and the second operating mode, is pivotable between a first stop lever position shown in FIG. 1*a* and a second stop lever position shown in FIG. 3*a*, the front or leading-edge stops 4, in the first operating mode, being maintained in the stop position against the sheet pile 5 while, in the second operating mode, they are maintained in the release position in which they are pivoted away from the pile 5. To execute a suitable pivoting or swivelling motion, the stop shaft 7 is rotatably supported or journalled, at a respective end region thereof, in a side wall 12 and 13, respectively, of the device (see FIG. 5). Analogously to the pivoting of the front or leading-edge stops 4 by means of the stop lever 11 fastened to the stop shaft 7, an adjustment of the catch arms 10 is effected by means of a tilt lever 14 connected to the catch lever shaft 8 which, in turn, carries the catch levers 9 to which the catch arms 10 are pivotably connected so that the latter, by means of the tilt lever 14, in a first tilt lever position thereof, are maintained in the basic position thereof and, in a second tilt lever position thereof are maintained in the catch position thereof.

The stop lever 11 is engaged by a spring 15 which, in a state of tension, has a tendency to maintain the stop lever 11 in the first stop lever position wherein the front or leading-edge stops 4 are disposed in the stop position thereof wherein they are pressed against the sheet pile 5. The spring 15 is formed as a leg spring. It has a spring core 15.3 formed as a helical spring having a respective end which merges into a first and a second spring leg 15.1 and 15.2, respectively. The spring core 15.3 is slid onto a stub shaft of the stop shaft 7 with which the stop lever 11 is also connected so as to be fixed against rotation relative thereto. The first spring leg 15.1 has a free end by which it engages in a recess 16 formed in the stop lever 11, while the second spring leg 15.2 cooperates with a cam 17, which is adjustable along an adjusting path represented by a double-headed arrow 18 (see FIG. 3*b*) between a first cam position and a second cam position. The cam 17 is carried by an adjusting member 19 formed as a plate pressed against the side wall 12 and, in turn, connected to a thrust rod 20 which is accommodated in guide bushings 21 fastened to the side wall 12.

In the first operating mode of the device shown in FIGS. 1*a* and 1*b*, the cam 17 is in the first cam position thereof. In this cam position, the cam 17 presses against the second spring leg 15.2 and thus keeps the spring 15, which is formed as a leg spring, in a state of tension. In the exemplary embodiment which is illustrated, this is achieved, moreover, by providing that a tensioning force exerted by the cam 17 on the second spring leg 15.2 be reinforced by means of a stop 22 (see FIG. 5), which prevents pivoting of the stop lever 11 under the action of the spring 15 beyond the first stop lever position. Altogether, the cam 17, in the first cam position thereof, thus holds the front or leading-edge stops 4, which are fastened to the stop shaft 7, by means of the spring 15 stressed in tension, and the stop lever 11, which is in the first stop lever position and is likewise connected to the stop shaft 7, in their stop position. By means of a suitable construction of the spring 15, whether by a predetermined shaping of the second spring leg 15.2 or by an adequately high spring force of the spring 14 in the first cam position of the cam 17, assurance is provided that the spring 15 will remain in the state of tension along a segment beginning at the location of the cam 17 and represented by the double-headed arrow 18.1 (see FIG. 2*b*) of the adjusting path represented by the arrow 18 in FIG.3*b*. The result is accordingly a lost motion for the device which assures that the front or leading-edge stops 4 will remain in the stop position thereof until the catch arms 10 have essentially assumed the catch position thereof. In the first operating mode, as shown in FIGS. 1*a* and 1*b*, the catch arms 10 are in the basic position thereof, and they reach the catch position thereof as a result of an adjustment of a sliding block 23 occurring jointly with the adjustment of the cam 17, the sliding block 23 being carried like the cam 17 by the adjusting member 19 and engaging in a suitable slot or coulisse 24 formed in the tilt lever 14 for pivoting the latter, during an adjustment of the sliding block 23 over the length of the adjusting path 18, out of the first tilt lever position and into the second tilt lever position. In a basic position of the catch arms 10 corresponding to the first operating mode shown in FIG. la wherein the cam 17 assumes the first cam position, the tilt lever 14 is in the first tilt lever position thereof wherein it is held by means of the sliding block 23. The aforementioned suitable construction of the slot 24 is understood in particular to mean such a construction that the tilt lever 14, upon a change from the first to the second operating mode, has already moved out of the tilt lever position thereof shown in FIG. 1*b*, after the adjustment of the cam 17 has occurred over the length of the segment 18.1 of the adjusting path 18, so as to assume a position which is at least substantially equivalent to the second tilt lever position wherein the catch arms 10 assume the catch position thereof. The front or leading-edge stops 4 remain in the stop position until the aforementioned position of the tilt lever 14 is reached (after the adjustment of the cam 17 by the length of the segment 18.1 of the adjusting path 18 has taken place), because of the aforementioned lost motion.

The aforementioned suitable construction of the slot or coulisse 24 is also understood to mean such a construction that the tilt lever 14, during an adjustment of the cam 17 following the segment 18.1 of the adjusting path 18 of the cam, and hence an adjustment of the sliding block 23 until the end of the adjusting path 18 is reached, still undergoes a slight adjustment, after which it is finally located in the second tilt lever position. A suitable construction of the slot 24 may also be such, however, that the tilt lever 14 assumes its second tilt lever position just after an adjustment of the cam 17 over the length of the segment 18.1 of the adjusting path 18 thereof, and that this second tilt lever position no longer varies during the further adjustment of the cam 17 up to the end of the adjusting path 18 thereof.

Figure 2B:
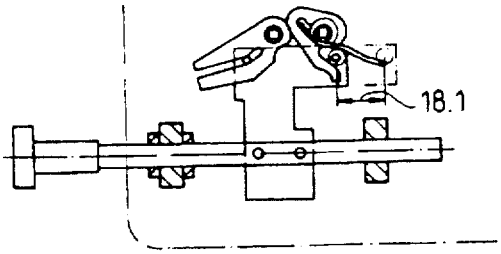
FIGS. 2*a* and 2*b*, 3*a* and 3*b*, and 4*a* and 4*b* are views similar to those of FIGS. 1*a* and 1*b*, respectively, in varying phases during a change of operating mode of the pile-forming device according to the invention.
Figure 2A:
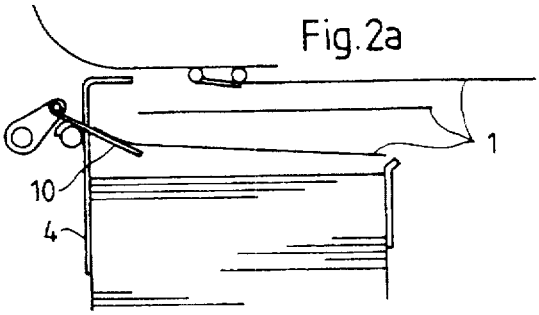
Figure 4B:
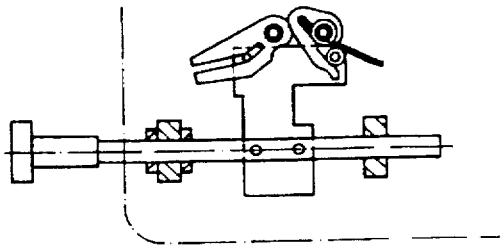
Figure 4A:
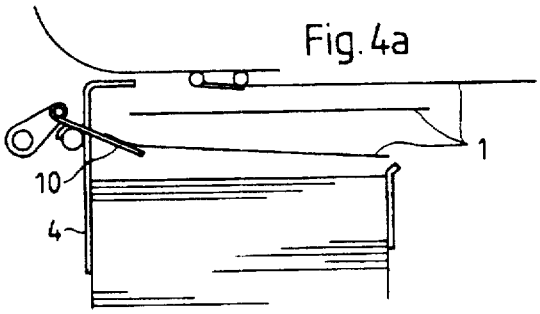

As is apparent particularly from FIG. 2*b*, the cam 17, which is operatively connected exclusively with the second spring leg 15.2 along the segment 18.1 of the adjusting path 18, reaches the end of this segment 18.1, contact being broken between the cam 17 and the second spring leg 15.2 resting on the stop lever 11, and pivots the stop lever 11 into the second stop lever position during the further adjustment of the cam 17 to as far as the end of the adjusting path 18 thereof, resulting in the front or leading-edge stops 4 being adjusted out of the stop position thereof and into the release position thereof. When this release position is reached, a change from the first to the second operating mode is then executed, with the result that the catch arms 10 are in the catch position thereof and the front or leading-edge stops 4 are in the release position thereof (see FIGS. 3*a* and 3*b*), corresponding to a position of the stop lever 11 in the second stop lever position, wherein the stop lever 11 is held by the cam 17 which is located in the second cam position. FIGS. 4*a* and 4*b* illustrate a phase wherein a change from the second operating mode to the first has occurred, such a change being executed by means of an adjustment of the thrust rod 20 in a direction opposite to the direction wherein a change has taken place from the configuration of FIGS. 1*a* and 1*b* to the configuration of FIGS. 2*a* and 2*b* and finally to the configuration of FIGS. 3*a* and 3*b*. Upon the adjustment of the thrust rod 20 in this opposite direction, the result from the details noted hereinbefore is that first, with the cam 17 once again in contact with the second spring leg 15.2, the front or leading-edge stops 4 are swiveled into the stop position, while the catch arms 10 remain yet in the catch position thereof. A second lost motion of the device which is responsible for this occurs as a result of the aforementioned suitable construction of the slot or coulisse 24. After the front or leading-edge stops 4 have regained the stop position thereof, they are then held in the stop position by the bracing of the stop lever 11 against the stop 22 in the further course of the adjustment of the thrust rod 20 in the aforementioned opposite direction, under the influence of the then again tensioned spring. In the exemplary embodiment according to FIG. 5, the front or leading-edge stops 4 are not at a standstill in the stop position thereof. Instead, they execute a shaking motion, which is imposed upon the stop shaft 7 by means of a revolving cam disk 25 and a roller lever 26 in engagement therewith and connected to the stop shaft 7. The aforementioned shaking motion is expressed as a pivoting motion, taking place about the pivot axis of the stop shaft 7, between the stop position of the front edge stops 4 shown in solid lines in FIGS. 1*a*, 2*a* and 4*a*, and a deflected position thereof qualitatively represented in phantom in FIG. 1*a*. In this exemplary embodiment, the aforementioned stop 22 can be omitted. Its function is taken over by the cam disk 25.

The herein aforementioned advantage of a relatively slight expenditure of force required to actuate the device thus offers a further advantage, which is that because of it, in particular, a relatively wide spacing can be selected between the respective stop shaft 7 and the catch lever shaft 8, on the one hand, and the thrust rod 20, on the other hand. This permits an ergonomically advantageous actuation of the device, not only with respect to the actuation force and the aforementioned actuation direction but also with respect to an actuation location. In the simplest possible way, impacts due to a rapid actuation of the thrust rod, as a result typically of a very rapidly performed change from one operating mode to the other, can also be damped by means of buffers 27, which are disposed on suitably selected end faces of the guide bushings 21.

The altogether simple functional parts for pivoting the stop shaft 7 and the catch lever shaft 8 can be made quite flat and can thus be accommodated in the device in an extremely space-saving manner.

With a corresponding choice of the disposition and geometry of the stop lever 11, the tilt lever 14, the catch lever 9 and the second spring leg 15.2, and with a corresponding design of the engagement ratios between the cam 17 and the stop lever 11, on the one hand, and between the sliding block 23 and the slot 24 of the tilt lever 14, on the other hand, a relatively short adjusting path 18 for changing from one operating state to the other can be attained.

Because of the forcible contact of the cam 17 with the second spring leg 15.2 and the stop lever 11, respectively, and because of the form-locking operative connection between the sliding block 23 and the tilt lever 14 by means of the slot or coulisse 24 formed thereon, a thoroughly functionally reliable follow-up control of the front or leading-edge stops 4, on the one hand, and the catch arms 10, on the other hand, is also produced.

I claim:

1. Device for forming a sheet pile from a sheet stream made up of substantially horizontally oriented descending sheets of paper, having leading-edge stops for the sheets, the stops being disposed on a front side of the pile; a stop shaft carrying the leading-edge stops; a stop lever which is secured to the stop shaft and is pivotable between a first and a second stop lever position in the course of a change between a first and a second mode of operation of the device, respectively, the stop lever, in the first stop lever position, keeping the leading-edge stops in engagement with the pile and, in the second stop lever position, keeping the leading-edge stops in a release position pivoted away from the pile; a spring engaging with the stop lever and, in a state of tension, having a tendency to keep the stop lever in the first stop lever position; a catch device with catch arms which, in the first operating mode of the device, are located in a basic position outside the sheet stream and, in the second operating mode, are in a catch position wherein they enter into the sheet stream; catch levers to which the catch arms are articulatedly connected; a catch lever shaft parallel to the stop shaft and carrying the catch levers; and a tilt lever secured to the catch lever shaft and being pivotable between a first and a second tilt lever position upon a change between the first operating mode and the second operating mode, respectively, the tilt lever, in the first tilt lever position, maintaining the catch arms in the basic position thereof and, in the second tilt lever position, maintaining the catch arms in the catch position thereof, comprising a cam adjustable along an adjusting path between a first and a second cam position; said cam maintaining the spring in a state of tension in said first cam position and along a segment of said adjusting path originating at said first cam position, and maintaining the stop lever in the second stop lever position in said second cam position; the tilt lever being formed with a slot or coulisse; a sliding block adjustable jointly with said cam being engageable in said slot formed in the tilt lever; said sliding block maintaining the tilt lever in the first and second tilt lever position, respectively, when said cam assumes said first and second cam position thereof, respectively.

2. Device according to claim 1, wherein the spring is constructed as a leg spring.

3. Device according to claim 1, including an adjusting member carrying said cam and said sliding block.

4. Device according to claim 1, wherein said adjusting path is aligned horizontally and perpendicularly to the stop shaft.

* * * * *